United States Patent [19]

Warden

[11] Patent Number: 4,645,254

[45] Date of Patent: Feb. 24, 1987

[54] PORTABLE GOLF BALL RETRIEVER

[76] Inventor: Roland R. Warden, 301 S. Evergreen, Wichita, Kans. 67209

[21] Appl. No.: 848,584

[22] Filed: Apr. 7, 1986

[51] Int. Cl.[4] ..... A63B 47/02

[52] U.S. Cl. ..... 294/19.2; 56/328 R; 414/440

[58] Field of Search ..... 294/19.2; 56/328 R, 56/332, 400.02, 400.03, 400.19; 171/58; 414/437, 439, 440

[56] References Cited

U.S. PATENT DOCUMENTS

| | | | |
|---|---|---|---|
| 2,110,538 | 3/1938 | Walsh | 294/19.2 X |
| 3,306,480 | 2/1967 | Wysong | 414/440 |
| 3,306,650 | 2/1967 | Zagwyn | 294/19.2 X |
| 3,744,225 | 7/1973 | Reeves | 56/328 R |
| 3,788,506 | 1/1974 | Lee | 414/440 |
| 3,922,027 | 11/1975 | Nesselt | 294/19.2 |
| 4,066,179 | 1/1978 | Livingston | 414/440 |
| 4,236,742 | 12/1980 | Florence | 294/19.2 X |
| 4,318,654 | 3/1982 | Lee | 294/19.2 X |
| 4,593,519 | 6/1986 | Kimball | 414/440 X |

*Primary Examiner*—Johnny D. Cherry
*Attorney, Agent, or Firm*—Kokjer, Kircher, Bradley, Wharton, Bowman & Johnson

[57] ABSTRACT

A portable golf ball retrieving tool has a shaft rotatably mounted on a handle. The shaft includes a number of spaced apart, slightly yieldable flat discs and has an extension at each end. A disc is mounted on each extension and the extensions include stub shafts which are telescoped into the ends of the tubular main shaft. The handle is made of multiple, relatively telescoping sections so that both the shaft and the handle can be collapsed to minimize the overall dimensions of the tool. The tool in its expanded position is rolled over a surface such as the bottom of a water hazard on a golf course. Golf balls encountered by the tool are rolled into positions between appropriately spaced apart discs where they are gripped between the disc pairs. The friction for gripping the golf balls is enhanced by a plurality of concentric ridges on the outer margins of the disc surfaces.

10 Claims, 5 Drawing Figures

PORTABLE GOLF BALL RETRIEVER

This invention relates to golf ball retrievers, and more particularly to a retriever which is particularly constructed in a manner to be carried by a golfer as, for example, in his golf bag for use in retrieving golf balls from relatively inaccessible locations, such as water hazards and the like. Golf balls are likely to enter water hazards from which they are often lost from further use to the owner. Heretofore, various devices have been utilized by golfers in an attempt to retrieve such lost balls. Often the balls are concealed from the golfer's view, making the retrieval process particularly difficult.

Tools such as rakes, hoes and the like have been employed for dragging the bottoms of the water hazards in an attempt to engage the lost ball and drag it from the hazard. Tools of this type are largely ineffective. While they may come into engagement with the ball beneath the surface of the water, the ball often readily disengages from the tool before it can be removed from the hazard. Tools incorporating rolling discs which grip the ball when it is engaged by the tool have been suggested. Rolling disc apparatuses have been utilized elsewhere in golf ball retrieval operations. Machines employing rotatable discs are commonly driven over golf driving ranges to gather scattered balls for reuse by the practicing golfers.

Heretofore, the rolling disc tools have met with only limited acceptance for use by the individual golfer. First, the tools have been too unwieldly for the golfer to carry with him when playing a round of golf. In an attempt to hold the weight to a minimum, the tools have typically been constructed in a manner wherein they are capable of providing a relatively narrow sweep. Since the golfer usually cannot see the ball lying at the bottom of a water hazard, the use of such tools has been largely a hit or miss affair. If the golfer happens to engage the ball, the latter might be recovered. More frequently, however, the golfer abandons the effort after numerous failures to engage the tool against the ball in the precise manner required for effecting a gripping of the ball in a manner to achieve successful retrieval.

Accordingly, it is a primary object of this invention to provide a golf ball retrieving tool constructed in a manner wherein it is readily portable and may be easily carried with the golfer, as in the golf bag or the like.

In the accomplishment of the foregoing object, it is an object of invention to provide a golf ball retrieval tool which may be collapsed to a relatively small size, yet which is expandable to a substantially larger size when used to greatly increase the chance for retrieval of an errant golf ball.

Another important object of the invention is to provide a golf ball retrieval tool which is constructed in a manner to be highly effective in gripping each golf ball with which it comes into engagement during use.

A still further object of the invention is to provide a golf ball tool of this type which may be readily constructed from strong but relatively lightweight materials and which may be carried in a condition wherein the overall dimensions of the tool are substantially similar to the golf clubs normally carried by the golfer.

These and further objects of the invention will be further explained or will be readily understood from the following description and claims.

Figure 1:
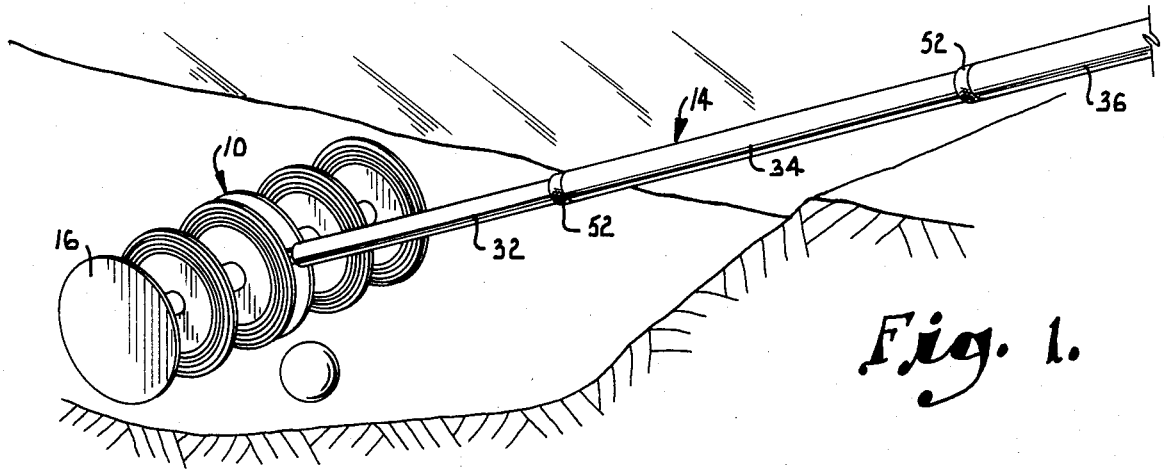
FIG. 1 is a fragmentary, perspective view of a tool embodying the principles of this invention illustrating the use of the tool to retrieve a golf ball from a water hazard shown in cross-section.

A tool embodying the principles of this invention is broadly designated in the drawings by the reference numeral 10. Tool 10 includes an elongated shaft 12 journalled to an elongated, rigid rod or handle 14 for the rolling of a plurality of discs 16 rigidly mounted on shaft 12 over a surface such as the bottom of a water hazard on a golf course, or the like. Shaft 12 comprises a plurality of mutually telescoped sections. A first section 18 includes a tube 20 of transversely circular configuration having a pair of identical, slightly yieldable, relatively flat closely spaced discs 26 and 28 rigidly mounted to tube 20 for rotation therewith.

Tool 10 includes a pair of identical extender sections 38 and 40. Each section includes a generally transversely circular pronged shaft 42 received in telescoped relationship into the corresponding end of tube 20. Discs 22 and 24, also identical to discs 26–28 are rigidly secured at the outermost ends of the corresponding pronged shafts 42 of the extender sections as shown.

Tool 10 also includes another pair of like extender sections 55 and 56. Each section includes a transversely circular pronged shaft 57 received in telescoped relationship in the outer end of the respective tubes 42 of the corresponding sections 38 and 40. Discs 44 and 46 also identical to the other discs are rigidly secured at the outermost ends of pronged shafts 57.

The spacing between discs of each of the following pairs 44–22, 22–28, 26–24, 24–46 is preferably slightly less than the diameter of a golf ball. In no event should the spacing be greater than the golf ball diameter. On the other hand, the relatively narrow spacing between discs 26 and 28 accommodates an elongated, relatively rigid element 30 bent into a U-shape or keyhole configuration so that the element wraps around the transversely circular outer surface of the zone of tube 20 defined by the closely spaced discs as shown in the drawing. Preferably, element 30 is of transversely square configuration as shown in FIG. 3 of the drawing so that the inner flat surface of element 30 complementally embraces the circular outer surface of the zone to permit tube 20 to rotate about its longitudinal axis with respect to the element.

The free ends of element 30 are secured to the proximal component 32 of handle 14. The latter is comprised of a plurality of rigid, tubular, elongated components 32, 34 and 36 which are telescoped together as shown in the drawing. In the preferred construction, the free ends of element 30 are received in telescoped relationship into the end of the tubular component 32 with a tight friction fit. If desired, element 30 may be riveted or otherwise secured to the component.

Figure 2:
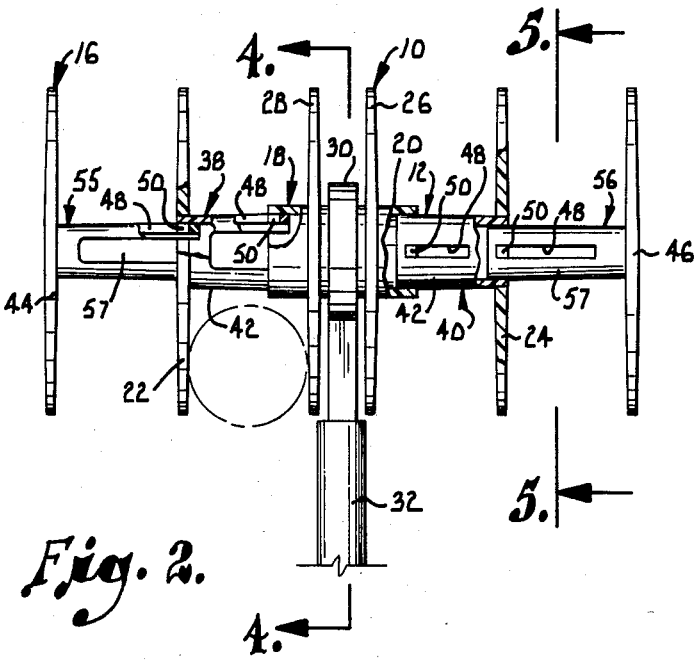
FIG. 2 is a fragmentary, top plan view of the tool of FIG. 1 on a larger scale, parts being broken away and shown in cross-section to reveal details of construction, a golf ball being shown in its gripped position in broken lines.
Figure 3:
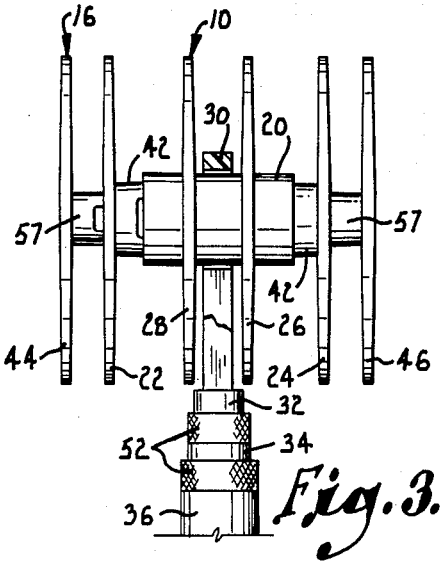
FIG. 3 is a view similar to FIG. 2 but showing the tool in its collapsed condition.
Figure 4:
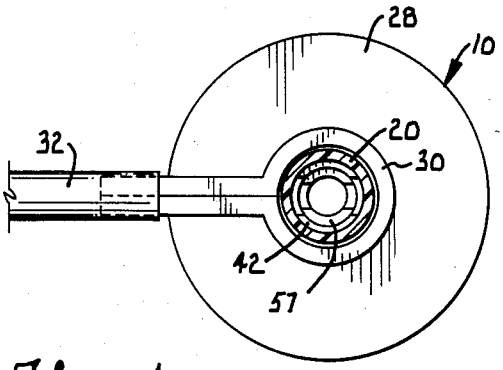
FIG. 4 is a detailed cross-sectional view taken along line 4—4 of FIG. 2.

The telescoped construction of tool 10 permits the pronged shafts to be moved by sliding to the positions thereof illustrated in FIG. 3 wherein discs 44 and 22 are in abutting relationship as are discs 24 and 46. By the same token, the pronged shafts can be moved to the extended positions illustrated in FIG. 2 wherein the spacings between respective disc pairs 44 and 22, 22 and 28, 26 and 24, 24 and 46, are equal and amounts to a distance slightly less than the diameter of a golf ball.

Means to restrict the relative telescoping of the pronged shafts 42 with respect to tube 20 and pronged shafts 57 with respect to tubes 42 include an elongated, longitudinally extending groove 48 in each respective pronged shaft. The latter are advantageously of generally tubular construction to minimize the weight of the tool. A stop 50 for each end of tube 20 and pronged shafts 42 is molded internally in the respective tubes and shafts near the ends thereof and each of the stops projects inwardly into corresponding grooves 48 as shown. The lengths of the respective slots 48 and the positions of the corresponding stops 50 determine the extent of outward sliding movement of each pronged shaft 42 and 57 as will be readily understood.

In the preferred construction, frictionable structures are provided on the tool first section and on the respective extender sections to releasably secure the respective sections against relatively telescoping when the sections are in the extended positions. It has been found that a slight tapering of the pronged portion of shafts 42 and 57 is adequate for this purpose. Such tapering causes the side walls of the shafts to impinge against the outer surface of the respective tube in which it is inserted, causing the respective sections to be held in these extended positions.

Desirably, the lowermost ends of the handle components 34 and 36 are provided with manually rotatable friction latches 52. Thus, the handle components may be relatively telescoped to their extended positions as illustrated in FIG. 1 and locked to provide a handle for manual manipulation of the tool. When desired, the latches 52 are released to permit the components to be telescoped upon one another for compact portability as illustrated in FIG. 3 of the drawing.

Figure 5:
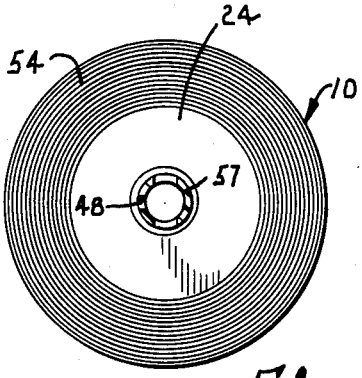
FIG. 5 is a view similar to FIG. 4 but taken along line 5—5 of FIG. 2.

Those surfaces of the discs which face a surface of a corresponding disc in position to engage a golf ball therebetween are preferably enhanced to increase the frictional gripping effect on the ball. FIG. 5 illustrates the surface enhancement on disc 24. Such enhancement includes a region 54 proximal the outer peripheral margin of the disc which is provided with a plurality of relatively fine, concentric, spaced apart ridges projecting outwardly from the disc surface. These ridges tend to increase the frictional engagement of a ball between the disc pairs.

In addition, each disc cross section has a slight widening taper from its outer edge inward to the point where is connects to its respective shaft. This taper provides a narrowing of the spacing between discs so that the deeper a golf ball is engaged between discs the tighter the gripping effect.

In use, the sections of shaft 12 and the components of handle 14 are moved to the collapsed positions so that tool 10 occupies minimum space and so that the tool is of a size generally similar to the clubs conventionally carried by the golfer in a golfing bag. In this condition, the tool can be readily carried in the bag along with the clubs. The tool is preferably constructed of relatively lightweight material. The handle may be made from aluminum, but other strong, lightweight material could be used. The sections of the shaft and the discs are preferably molded from strong, durable plastic material. In the preferred construction, the discs are molded integrally with the respective shaft sections and are of sufficiently thin, slightly yieldable plastic material so that a gold ball may readily become engaged between respective spaced apart disc pairs.

If the golfer has the misfortune of driving a golf ball into a water hazard, the golfer extends the tool by grasping the outermost discs and moving the stub shafts to the positions illustrated in FIG. 2. The golfer also extends the handle and locks the handle components into the extended position. Manual manipulation of the tool by rolling the discs over the lake bottom results in the ball, when encountered by the tool, becoming lodged between a spaced apart disc pair. The friction ridges on the disc surfaces ensure that the ball remains in its lodged position until the tool is rolled from the hazard. Obviously, the ball may be then easily removed manually from between the discs. Once the ball has been recovered, the sections may be again moved to the collapsed positions for carrying.

The flat inner surface of element 30 complementally engaging the cylindrical zone at the middle of the tool rolling member provides substantial bearing surface to resist any tendency for the shaft to cant with respect to the handle. Further, the relatively close spacing of the adjacent discs 26 and 28 affords substantial surface area on the discs in position to engage the flat side faces of element 30 to assist in preventing any canting about an axis normal to the longitudinal axis of the tool shaft. This design permits a construction involving a minimum amount of weight yet with the necessary structural integrity for the tool to be used for sweeping a relatively wide area across the irregular terrain often encountered in water hazards for effectively recovering lost golf balls.

While the invention has been described particularly with respect to its use for recovering golf balls from water hazards, it will be readily apparent to those skilled in the art that the principles set forth might be utilized for recovery of any of a number of relatively spherical objects. Further, the tool could be used for recovering golf balls or other items from relatively inaccessible locations other than water hazards on golf courses.

Having thus described the invention, I claim:

1. A portable golf ball retrieving tool comprising:

a shaft;

handle means;

means journalling said shaft on the handle means for rotation about the shaft longitudinal axis;

said shaft comprising a plurality of relatively telescoping sections whereby the shaft may be collapsed longitudinally from an expanded condition to a retracted position of substantially shorter length than said expanded condition;

a plurality of at least slightly resilient discs mounted on the shaft for rotation therewith, there being at least one disc on each shaft section respectively, the spacing between adjacent discs being no greater than the diameter of a golf ball when the shaft is in said expanded condition so that a ball lodged between a pair of adjacent discs is frictionally gripped therebetween, and whereby the shaft may be collapsed for ready portability of the tool, and expanded for rolling manipulation over a surface to effect lodgement of golf balls between the discs for retrieval when encountered by the tool.

2. A tool as set forth in claim 1, wherein said handle means includes a plurality of elongated, rigid, tubular components, said components being in relatively telescoped disposition to enhance the portability of the tool and movable to dispositions with the respective components in substantial extension longitudinally from one another to increase the length of the handle means for manual manipulation of the tool.

3. A tool as set forth in claim 2, wherein the handle means includes releaseable lock means engageable with said handle components for securing the latter in their extended positions.

4. A tool as set forth in claim 1, wherein said discs are provided with friction enhancing means on the surfaces thereof to increase the gripping of any golf ball lodged between adjacent discs.

5. A tool as set forth in claim 4, wherein said friction enhancing means includes a plurality of spaced apart ridges on the respective disc surfaces and projecting laterally therefrom, said ridges being circular and concentric to the longitudinal axis of the shaft.

6. A tool as set forth in claim 1, wherein said shaft includes a first tubular section having opposed ends and including a zone having a transversely circular outer surface spaced an equal distance from the ends of said first section, there being a pair of discs rigidly mounted on the shaft first section in relatively closely spaced apart relationship, said handle means comprising an elongated, rigid handle with opposed ends, and wherein said shaft journalling means includes an elongated, relatively rigid element extending from one end of the handle in looped relationship around said zone of the shaft between said closely spaced discs for rolling of the shaft along said surface by manual manipulation of said handle.

7. A tool as set forth in claim 6, wherein the inner surface of at least the portion of said element looped around said shaft zone having a transversely circular outer surface extends in embracing relationship around the zone.

8. A tool as set forth in claim 6, wherein said tool includes at least one extender section for each end of the shaft first section respectively;

each extender section including a transversely circular, elongated shaft section received in telescoped relationship in the corresponding end of said first section, and a disc rigidly mounted on each extender section exteriorly of said first section, the extender sections being slidable longitudinally with respect to the first tubular section; and means cooperating with said first section and the respective extender sections to limit the outward telescoping of the latter to a predetermined amount to provide a spacing between adjacent pairs of discs to no greater than the diameter of a golf ball.

9. A tool as set forth in claim 8, wherein said cooperating means includes a longitudinally extended groove in each respective extender section, and a stop for each groove respectively, said stops being carried by said first section and extending into the corresponding grooves to limit telescoping movement of the extender sections by engagement of the respective ends of the grooves on the corresponding stops.

10. A tool as set forth in claim 8, wherein said shaft includes a pair of first and second extender shaft sections on each end of the first section, each first extender section having opposed ends and being telescoped in the respective end of said first section, each second extender section being telescoped in a corresponding end of its respective paired first extender section.

* * * * *